US011230457B2

(12) United States Patent
Shiraishi et al.

(10) Patent No.: US 11,230,457 B2
(45) Date of Patent: Jan. 25, 2022

(54) ELEVATOR APPARATUS

(71) Applicant: MITSUBISHI ELECTRIC CORPORATION, Chiyoda-ku (JP)

(72) Inventors: Naohiro Shiraishi, Chiyoda-ku (JP); Seiji Watanabe, Chiyoda-ku (JP); Kotaro Fukui, Chiyoda-ku (JP); Eiji Ando, Chiyoda-ku (JP); Shiro Ikeda, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 657 days.

(21) Appl. No.: 15/765,623

(22) PCT Filed: Dec. 1, 2015

(86) PCT No.: PCT/JP2015/083736
§ 371 (c)(1),
(2) Date: Apr. 3, 2018

(87) PCT Pub. No.: WO2017/094102
PCT Pub. Date: Jun. 8, 2017

(65) Prior Publication Data

US 2018/0297814 A1 Oct. 18, 2018

(51) Int. Cl.
*B66B 5/22* (2006.01)
*B66B 5/18* (2006.01)
*B66B 5/04* (2006.01)

(52) U.S. Cl.
CPC ..... *B66B 5/22* (2013.01); *B66B 5/044* (2013.01); *B66B 5/18* (2013.01)

(58) Field of Classification Search
CPC ..... B66B 5/044; B66B 5/18
See application file for complete search history.

(56) References Cited

U.S. PATENT DOCUMENTS 4,083,432 A 4/1978 Lusti
5,096,020 A * 3/1992 Korhonen ..... B66B 5/22 187/359

(Continued)

FOREIGN PATENT DOCUMENTS

CN 104395220 A 3/2015
CN 105000446 A 10/2015

(Continued)

OTHER PUBLICATIONS

International Search Report dated Mar. 8, 2016, in PCT/JP2015/083736 filed Dec. 1, 2015.

(Continued)

*Primary Examiner* — Diem M Tran
(74) *Attorney, Agent, or Firm* — Xsensus LLP

(57) ABSTRACT

In an elevator apparatus, an activating lever that activates an emergency safety gear is disposed on the emergency safety gear. A speed governor mechanism has: a speed governor sheave; a tensioning sheave; and a speed governor rope that is wound onto the speed governor sheave and the tensioning sheave, and that is connected to the activating lever. A resistance applying mechanism is disposed on the car. The resistance applying mechanism applies a resisting force during ascent of the car against movement of the activating lever in a direction that activates the emergency safety gear.

10 Claims, 13 Drawing Sheets

(56) References Cited

U.S. PATENT DOCUMENTS

| | | | | | |
|---|---|---|---|---|---|
| 5,230,406 | A * | 7/1993 | Poon | B66B 5/04 | 187/376 |
| 6,997,287 | B2 * | 2/2006 | Sasaki | B66B 5/22 | 187/376 |
| 8,869,946 | B2 * | 10/2014 | Okada | B66B 5/18 | 187/350 |
| 2001/0047910 | A1 * | 12/2001 | Barker | F16F 7/08 | 187/376 |
| 2012/0175194 | A1 * | 7/2012 | Nikawa | B66B 5/22 | 187/376 |
| 2017/0101292 | A1 * | 4/2017 | Powers | B66B 5/22 | |

FOREIGN PATENT DOCUMENTS

| | | | | |
|---|---|---|---|---|
| JP | 53-71445 | A | 6/1978 | |
| JP | 2012-62124 | A | 3/2012 | |
| JP | 2012-162374 | A | 8/2012 | |
| WO | 2013190869 | A1 | 12/2013 | |
| WO | WO-2013190869 | A1 * | 12/2013 | B66B 5/18 |

OTHER PUBLICATIONS

Chinese Office Action dated Jan. 31, 2019 in Chinese Application No. 201580084761.2.

* cited by examiner

ELEVATOR APPARATUS

TECHNICAL FIELD

The present invention relates to an elevator apparatus that makes a car perform an emergency stop using an emergency safety gear if a suspending body breaks, for example.

BACKGROUND ART

In conventional elevator apparatus speed governors, a first overspeed Vos (an activating speed of an operation stopping switch) is set to approximately 1.3 times a rated speed Vo, and a second overspeed Vtr (a safety tripping speed) is set to approximately 1.4 times the rated speed Vo. If it is detected that car speed has exceeded the rated speed and reached the first overspeed Vos, due to an abnormality in the controlling apparatus, for example, power supply to a hoisting machine is interrupted to stop the car urgently using a hoisting machine brake. If it is detected that the car is falling due to breakage of a main rope, etc., and the car speed reaches the second overspeed Vtr, an emergency safety gear activates to make the car perform emergency stopping.

However, if the car is positioned in a vicinity of a lowest floor in a hoistway, and the car reaches a bottom portion of the hoistway before the car speed reaches the first overspeed Vos and the second overspeed Vtr, the car is made to decelerate and stop by a buffer. For this purpose, a longer buffering stroke is required in the buffer as the speed that must be decelerated increases, and the length of the buffer is determined by the first overspeed Vos and the second overspeed Vtr. Furthermore, if the buffer is lengthened, pit depth of the hoistway must be increased.

In answer to that, in conventional double-deck elevators, inertial masses are added to speed governor ropes that are respectively installed on an upper car and a lower car that can mutually move in opposite vertical directions inside a car frame. If a rope that drives the upper car or the lower car breaks, an emergency safety gear is activated at high response by forces of inertia that arise as a result of acceleration of a car falling (see Patent Literature 1, for example).

In other conventional elevator apparatuses, an emergency safety gear is activated by a large car acceleration that arises due to rope breakage. An angle of an activating lever, tension of a speed governor rope, and rotational inertial mass of a speed governor mechanism are also set such that the emergency safety gear does not malfunction at a small acceleration (see Patent Literature 2, for example).

CITATION LIST

Patent Literature

[Patent Literature 1]
Japanese Patent Laid-Open No. 2012-62124 (Gazette)
[Patent Literature 2]
Japanese Patent Laid-Open No. 2012-162374 (Gazette)

SUMMARY OF THE INVENTION

Problem to be Solved by the Invention

In conventional elevator apparatuses such as those described above, if an ascending car is stopped suddenly by a hoisting machine brake for any reason, then the car decelerates by approximately 0.3 G. In other words, a downward acceleration occurs at the car. Because of that, there is a risk that the emergency safety gear may malfunction due to rotational inertial mass of the speed governor mechanism.

The present invention aims to solve the above problems and an object of the present invention is to provide an elevator apparatus that enables space saving in a hoistway by a simple configuration, while preventing malfunction of an emergency safety gear.

Means for Solving the Problem

An elevator apparatus according to the present invention includes: a car that ascends and descends through a hoistway; a car guide rail that guides ascent and descent of the car; a suspending body that suspends the car; an emergency safety gear that is disposed on the car, and that grips the car guide rail to make the car perform emergency stopping; an activating lever that is disposed on the emergency safety gear, and that activates the emergency safety gear; a speed governor mechanism that includes: a speed governor sheave; a tensioning sheave that is disposed so as to be spaced apart from the speed governor sheave in a vertical direction; and a speed governor rope that is wound onto the speed governor sheave and the tensioning sheave, and that is connected to the activating lever; and a resistance applying mechanism that is disposed on the car, and that applies a resisting force during ascent of the car against movement of the activating lever in a direction that activates the emergency safety gear.

An elevator apparatus includes: a car that ascends and descends through a hoistway; a car guide rail that guides ascent and descent of the car; a suspending body that suspends the car; an emergency safety gear that is disposed on the car, and that grips the car guide rail to make the car perform emergency stopping; an activating lever that is disposed on the emergency safety gear, and that activates the emergency safety gear; a speed governor mechanism that includes: a speed governor sheave; a tensioning sheave that is disposed so as to be spaced apart from the speed governor sheave in a vertical direction; and a speed governor rope that is wound onto the speed governor sheave and the tensioning sheave, and that is connected to the activating lever; and an activation restricting mechanism that is disposed on the car, and that restricts movement of the activating lever in a direction that activates the emergency safety gear during ascent of the car.

Effects of the Invention

In an elevator apparatus according to the present invention, because a resisting force is applied to movement of an activating lever, or movement of the activating lever is restricted, during ascent of a car, space saving in a hoistway can be achieved by a simple configuration, while preventing malfunction of an emergency safety gear.

DESCRIPTION OF EMBODIMENTS

Preferred embodiments of the present invention will now be explained with reference to the drawings.

Embodiment 1

Figure 1:
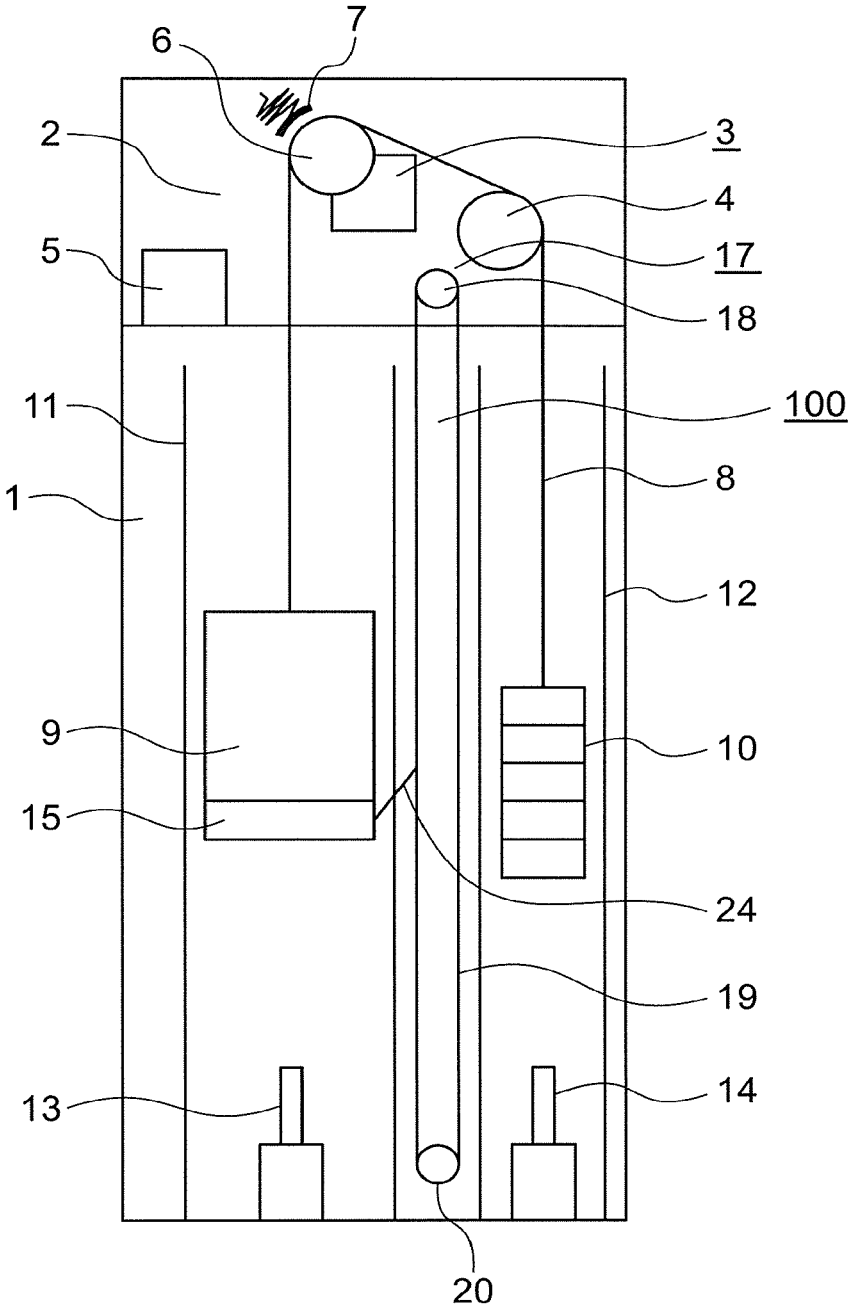
FIG. 1 is a configuration diagram that schematically shows an elevator apparatus according to Embodiment 1 of the present invention.

FIG. 1 is a configuration diagram that schematically shows an elevator apparatus according to Embodiment 1 of the present invention. In the figure, a machine room 2 is disposed in an upper portion of a hoistway 1. A hoisting machine 3, a deflecting sheave 4, and a controlling apparatus 5 are installed in the machine room 2. The hoisting machine 3 has: a driving sheave 6; a hoisting machine motor that rotates the driving sheave 6; and a hoisting machine brake 7 that brakes rotation of the driving sheave 6.

The hoisting machine brake 7 has: a brake wheel that is coupled coaxially to the driving sheave 6; a brake shoe that brakes rotation of the brake wheel by contacting the brake wheel; a brake spring that presses the brake shoe against the brake wheel to apply a braking force; and an electromagnet that pulls the brake shoe away from the brake wheel in opposition to the brake spring to release the braking force.

A suspending body 8 is wound around the driving sheave 6 and the deflecting sheave 4. A plurality of ropes or a plurality of belts are used as the suspending body 8. A car 9 is connected to a first end portion of the suspending body 8. A counterweight 10 is connected to a second end portion of the suspending body 8.

The car 9 and the counterweight 10 are suspended inside the hoistway 1 by the suspending body 8, and are raised and lowered inside the hoistway 1 by rotating the driving sheave 6. The controlling apparatus 5 raises and lowers the car 9 at a set speed by controlling the hoisting machine 3.

A pair of car guide rails 11 that guide raising and lowering of the car 9 and a pair of counterweight guide rails 12 that guide raising and lowering of the counterweight 10 are installed inside the hoistway 1. A car buffer 13 that buffers collision of the car 9 into a bottom portion of the hoistway 1, and a counterweight buffer 14 that buffers collision of the counterweight 10 into the bottom portion of the hoistway 1 are installed on the bottom portion of the hoistway 1.

An emergency safety gear 15 that makes the car 9 perform emergency stopping by gripping a car guide rail 11 is mounted onto a lower portion of the car 9. A gradual emergency safety gear is used as the emergency safety gear 15. Gradual emergency safety gears are generally used in elevator apparatuses in which rated velocity exceeds 45 m/min.

A speed governor 17 that detects overspeed traveling of the car 9 is disposed in the machine room 2. The speed governor 17 has: a speed governor sheave 18; an overspeed detecting switch; a rope catch, etc. A speed governor rope 19 is wound around the speed governor sheave 18.

The speed governor rope 19 is installed in a loop inside the hoistway 1, and is connected to the emergency safety gear 15. The speed governor rope 19 is wound around a tensioning sheave 20 that is disposed in a lower portion of the hoistway 1. The speed governor rope 19 moves cyclically when the car 9 ascends and descends, rotating the speed governor sheave 18 at a rotational speed that corresponds to the traveling speed of the car 9.

The traveling speed of the car 9 reaching the overspeeds is detected mechanically by the speed governor 17. A first overspeed Vos that is higher than a rated speed Vo and a second overspeed Vtr that is higher than the first overspeed Vos are set as detected overspeeds in the speed governor 17.

The overspeed detecting switch is operated if the traveling speed of the car 9 reaches the first overspeed Vos. When the overspeed detecting switch is operated, power supply to the hoisting machine 3 is interrupted, operating the hoisting machine brake 7 to stop the car 9 urgently.

If the descent speed of the car 9 reaches the second overspeed Vtr, the speed governor rope 19 is gripped by the rope catch, stopping the cycling of the speed governor rope 19. When the cycling of the speed governor rope 19 is stopped, an activating lever 16 is operated, operating the emergency safety gear 15 to make the car 9 perform an emergency stop.

Figure 2:
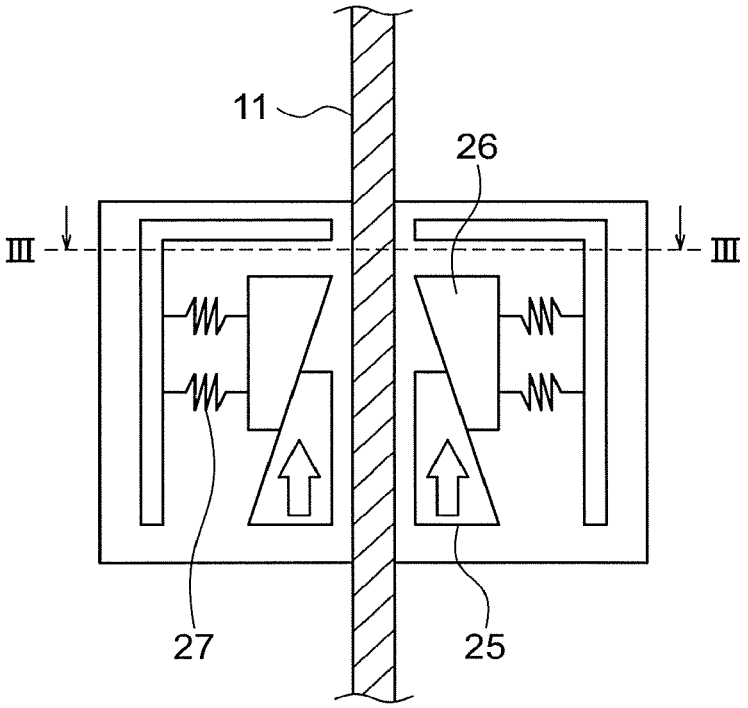
FIG. 2 is a front elevation that shows a relationship between a car guide rail and an emergency safety gear from FIG. 1.
Figure 3:
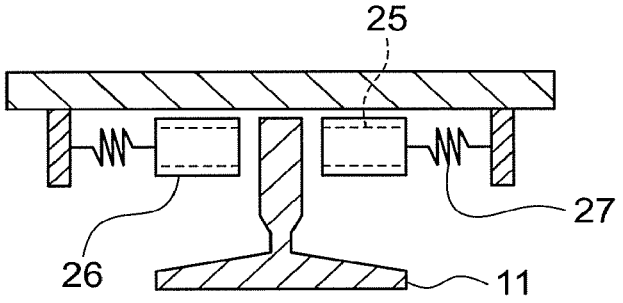
FIG. 3 is a cross section that is taken along Line III-III in FIG. 2.

FIG. 2 is a front elevation that shows a relationship between a car guide rail 11 and the emergency safety gear 15 from FIG. 1, and FIG. 3 is a cross section that is taken along Line III-III in FIG. 2. The emergency safety gear 15 has pairs of left and right gripping portions that grip corresponding car guide rails 11. As shown in FIG. 2, each of the gripping portions has a pair of wedges 25, a pair of wedge guides 26, and a plurality of wedge guiding springs 27.

The wedges 25 are movable vertically relative to a frame body of the emergency safety gear 15 along inclined surfaces that are disposed on the wedge guides 26. The wedge guiding springs 27 are disposed between the frame body of the emergency safety gear 15 and the wedge guides 26.

As shown in FIG. 2, the wedges 25 face the car guide rail 11 so as to have a gap interposed during normal operation. In contrast to that, the wedges 25 are lifted up when the emergency safety gear 15 is operating. Here, the wedges 25 approach the car guide rail 11 along the wedge guides 26, and ultimately contact the car guide rail 11.

As the wedges 25 are lifted even further, the wedges 25 push the wedge guides 26 horizontally so as to compress the wedge guiding springs 27 while moving upward. Pressing force from the wedges 25 that acts on the car guide rail 11 is increased by this compression of the wedge guiding springs 27, and frictional forces that are generated between the car guide rail 11 and the emergency safety gear 15 increase depending on the amount of bite of the wedges 25. The wedges 25 thereby grip the car guide rail 11, and the car 9 performs an emergency stop.

Figure 4:
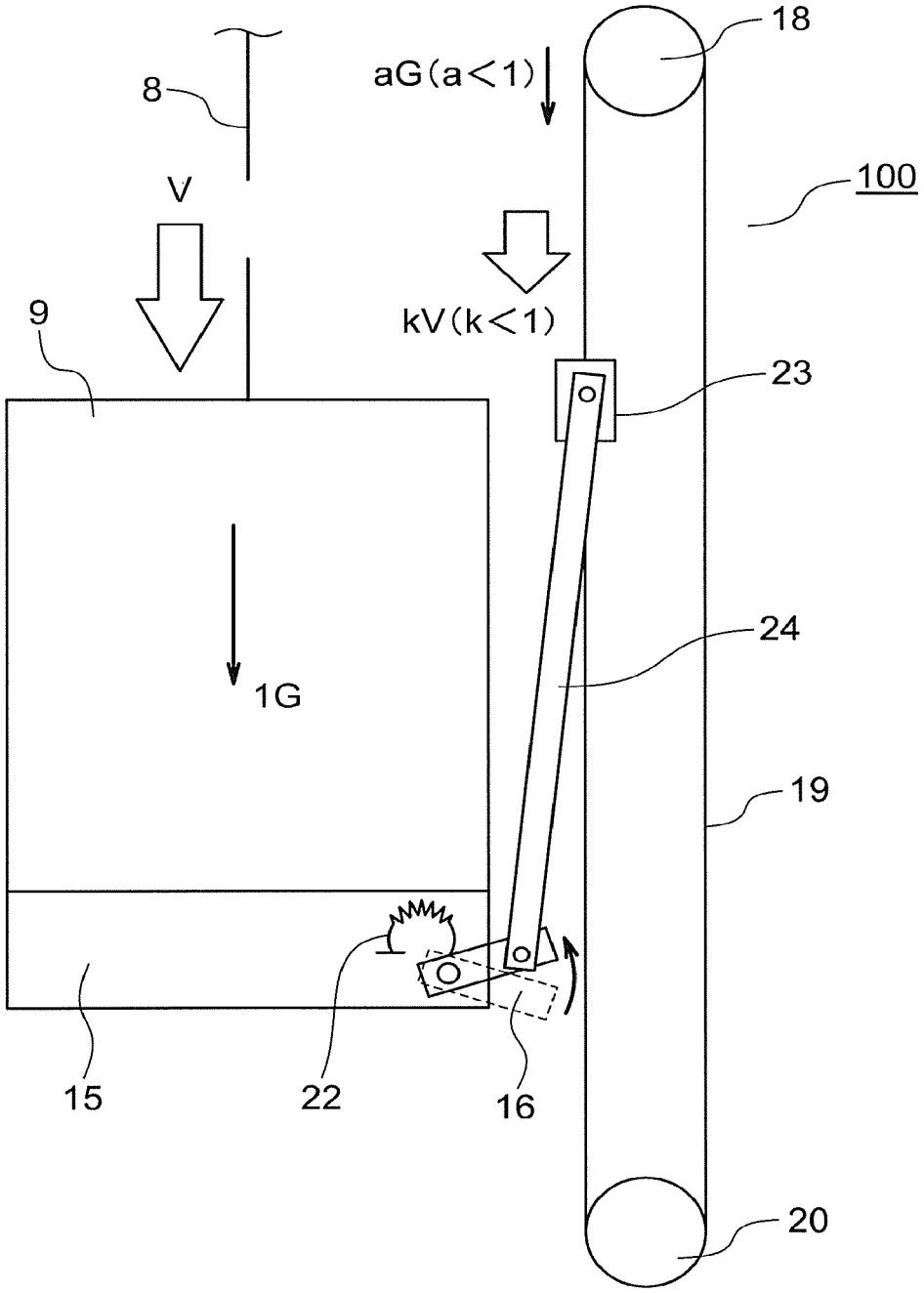
FIG. 4 is an explanatory diagram that shows action of the emergency safety gear during breakage of a suspending body from FIG. 1.

FIG. 4 is an explanatory diagram that shows action of the emergency safety gear 15 during breakage of the suspending body 8 from FIG. 1. Activating levers 16 (omitted in FIG. 1) that activate the emergency safety gear 15 are rotatably disposed on the emergency safety gear 15. The wedges 25 are connected to ends of the activating levers 16. When the activating levers 16 are lifted, i.e., rotated counterclockwise in FIG. 4, the wedges 25 are also lifted in synchronization with the activating levers 16. In other words, the emergency safety gear 15 is activated by rotating the activating levers 16 counterclockwise in FIG. 4.

A rotational spring 22 that functions as a malfunction preventing spring is disposed on the emergency safety gear 15. The rotational spring 22 applies a force to the activating levers 16 in an opposite direction (clockwise in FIG. 4) to the direction that activates the emergency safety gear 15. An initial amount of rotation is applied to the rotational spring 22. A resisting force against pulling the activating levers 16 upward is generated by this initial amount of rotation, preventing the activating levers 16 from rotating accidentally.

A linking portion 23 is fixed to the speed governor rope 19. A lifting rod 24 is connected between the linking portion 23 and the activating levers 16. In other words, the speed governor rope 19 is connected to the emergency safety gear 15 by means of the linking portion 23, the lifting rod 24, and the activating levers 16. An upper end portion of the lifting rod 24 is connected pivotably to the linking portion 23. In addition, a lower end portion of the lifting rod 24 is connected pivotably to the activating levers 16.

The speed governor mechanism 100 according to Embodiment 1 has a speed governor sheave 18, a speed governor rope 19, and a tensioning sheave 20. If the suspending body 8 breaks, the car 9 will fall downward at a gravitational acceleration of 1 G. Here, since the speed governor mechanism 100 is not affected by the gravitational force, it accelerates at aG ($a<1.0$), which is lower than 1 G. Because of that, a difference in acceleration arises between the car 9 and the speed governor mechanism 100. Thus, the speed of the speed governor mechanism 100 is kV ($k<1$), which is lower than the car speed V, which activates the emergency safety gear 15 by pulling the activating levers 16 upward.

Moreover, the car speed V during activation of the emergency safety gear 15 due to such differences in acceleration is lower than the rated speed Vo. In activation methods that use a difference in acceleration, the emergency safety gear 15 is activated after a constant amount of time from breakage of the suspending body 8 irrespective of car speed and car position.

Figure 5:
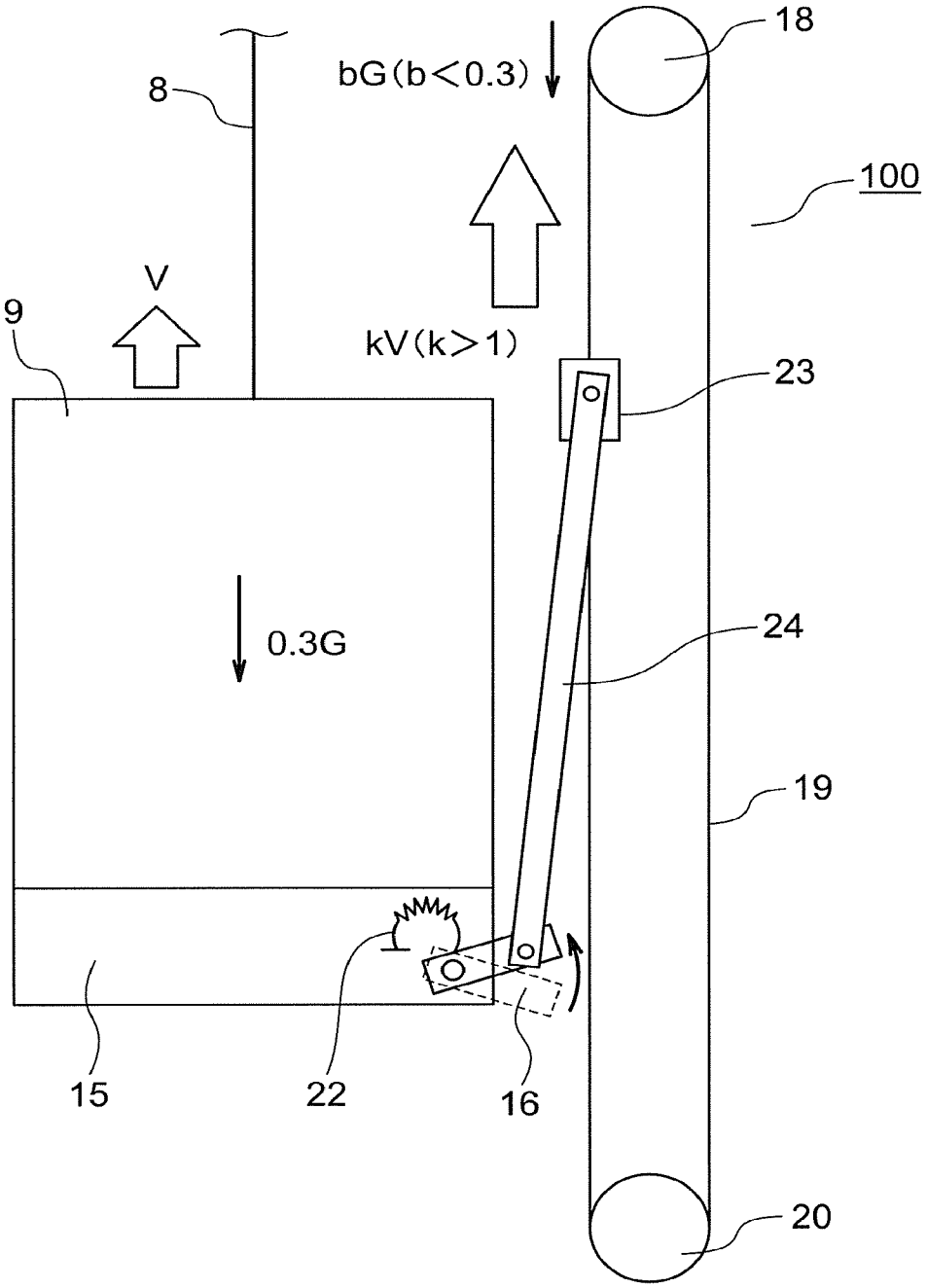
FIG. 5 is an explanatory diagram that shows malfunction of the emergency safety gear when a car stops suddenly due to a hoisting machine brake from FIG. 1.

FIG. 5 is an explanatory diagram that shows malfunction of the emergency safety gear 15 when a car 9 stops suddenly due to a hoisting machine brake 7 from FIG. 1. If the hoisting machine brake 7 operates during ascent of the car 9, the car 9 decelerates by approximately 0.3 G. At that point, a downward acceleration arises in the car 9. The speed governor mechanism 100, on the other hand, is not subjected directly to the braking decelerating force, and decelerates by an acceleration bG, which is lower than 0.3 G ($b<0.3$). Because of that, the speed kV of the speed governor mechanism 100 is faster than the speed V of the car 9 ($k>1$), and the emergency safety gear 15 will malfunction due to ascent of the activating levers 16.

Figure 6:
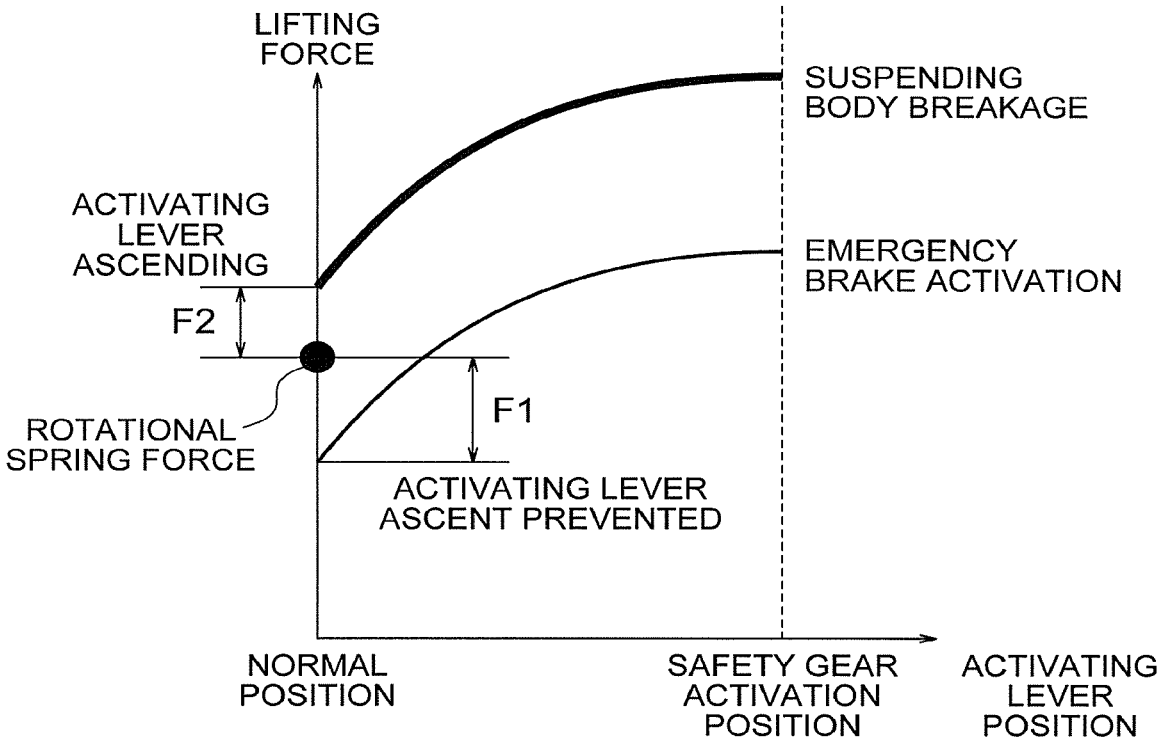
FIG. 6 is a graph that shows relationships between positions of an activating lever from FIG. 5 and lifting force on the activating lever.

Now, FIG. 6 is a graph that shows relationships between positions of the activating levers 16 from FIG. 5 and lifting force on the activating levers 16. During emergency brake activation, the spring force from the rotational spring 22 is stronger by F1 than the force that pulls the activating levers 16 upward, and the activating levers 16 do not rise. When the suspending body 8 is broken, on the other hand, the lifting force is stronger by F2 than the spring force from the rotational spring 22, and the emergency safety gear 15 activates.

Now, if the difference between the lifting force during emergency brake activation and during breakage of the suspending body 8 (F1+F2) is small, a spring force setting range of the rotational spring 22 that prevents malfunction is limited. Because of that, due to setting difficulties, malfunction of the emergency safety gear 15 may occur or car speed increases may arise due to a time lag in emergency safety gear 15 activation.

In order to solve this problem, in Embodiment 1, a resisting force against the rotation of the activating levers 16 is different during ascent and during descent of the car 9. Specifically, the resisting force against the rotation of the activating levers 16 is greater during ascent than during descent of the car 9. The activating levers 16 are thereby harder to move in the direction that activates the emergency safety gear 15 during ascent than during descent of the car 9.

Figure 7:
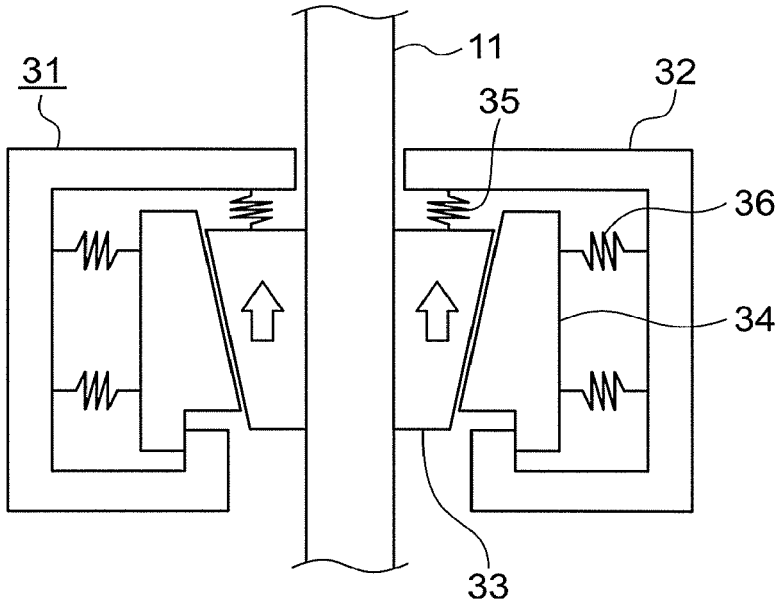
FIG. 7 is a configuration diagram that shows part of the elevator apparatus according to Embodiment 1.

FIG. 7 is a configuration diagram that shows part of the elevator apparatus according to Embodiment 1. In Embodiment 1, a resistance applying mechanism 31 is mounted to the car 9. The resistance applying mechanism 31 applies a resisting force against movement of the activating levers 16 in the direction that activates the emergency safety gear 15 during ascent of the car 9. The resistance applying mechanism 31 is disposed on a lower portion of the emergency safety gear 15 that is shown in FIG. 2.

In addition, the resistance applying mechanism 31 has a housing 32, a pair of wedge-shaped friction members 33, a pair of friction member guides 34, a plurality of friction member supporting springs 35, and a plurality of guide pressing springs 36. The housing 32 is mounted to the car 9.

The friction members 33 are movable vertically relative to the housing 32 along inclined surfaces that are disposed on the friction member guides 34. The friction member supporting springs 35 are disposed between the housing 32 and the friction members 33. The guide pressing springs 36 are disposed between the housing 32 and the friction member guides 34.

The friction members 33 are disposed on two sides of a car guide rail 11 so as to face each other across the car guide rail 11, and are in contact with the car guide rail 11. The friction member guides 34 are displaceable in directions that are perpendicular to surfaces of the car guide rail 11 that the friction members 33 contact. The friction member guides 34 are pressed toward the car guide rail 11 by the guide pressing springs 36.

The inclined surfaces of the friction member guides 34 are closer to the car guide rail 11 toward a lower end. Thus, the resistance applying mechanism 31 has a configuration that is approximately a vertical inversion of the emergency safety gear 15.

FIG. 7 shows a state of the resistance applying mechanism 31 during descent of the car 9. Upward frictional forces act on the friction members 33 during descent of the car 9. Because of that, the spring forces from the guide pressing springs 36 decrease, reducing the frictional forces between the friction members 33 and the car guide rail 11.

Figure 8:
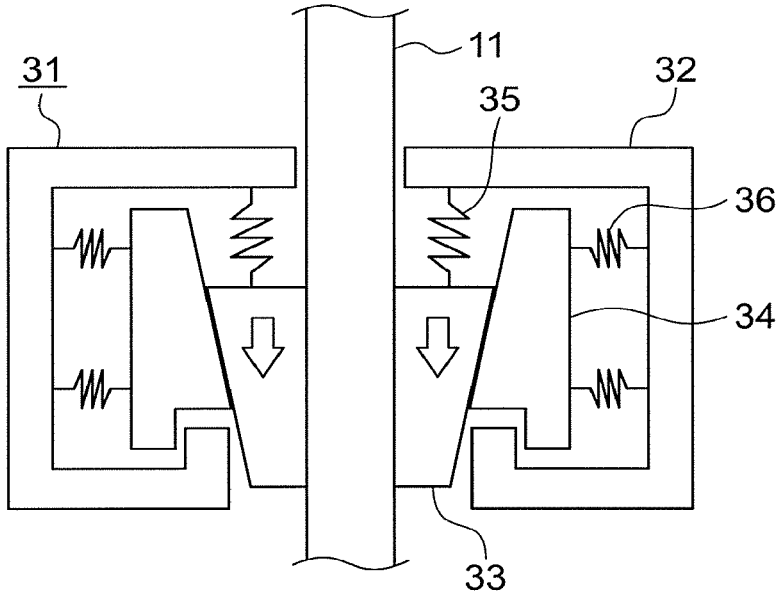
FIG. 8 is a configuration diagram that shows a state of a resistance applying mechanism from FIG. 7 during ascent of the car.

FIG. 8 is a configuration diagram that shows a state of the resistance applying mechanism 31 from FIG. 7 during ascent of the car 9. Downward frictional forces act on the friction members 33 during ascent of the car 9. The friction members 33 thereby wedge downward between the friction member guides 34, pushing spacing between the friction member guides 34 and the car guide rail 11 wider. As a result of that, the guide pressing springs 36 are compressed, increasing the pushing forces from the guide pressing springs 36, thereby increasing the frictional forces between the friction members 33 and the car guide rail 11.

Moreover, the frictional forces between the friction members 33 and the car guide rail 11 do not hinder traveling of the car 9 either during ascent or during descent of the car 9.

Figure 9:
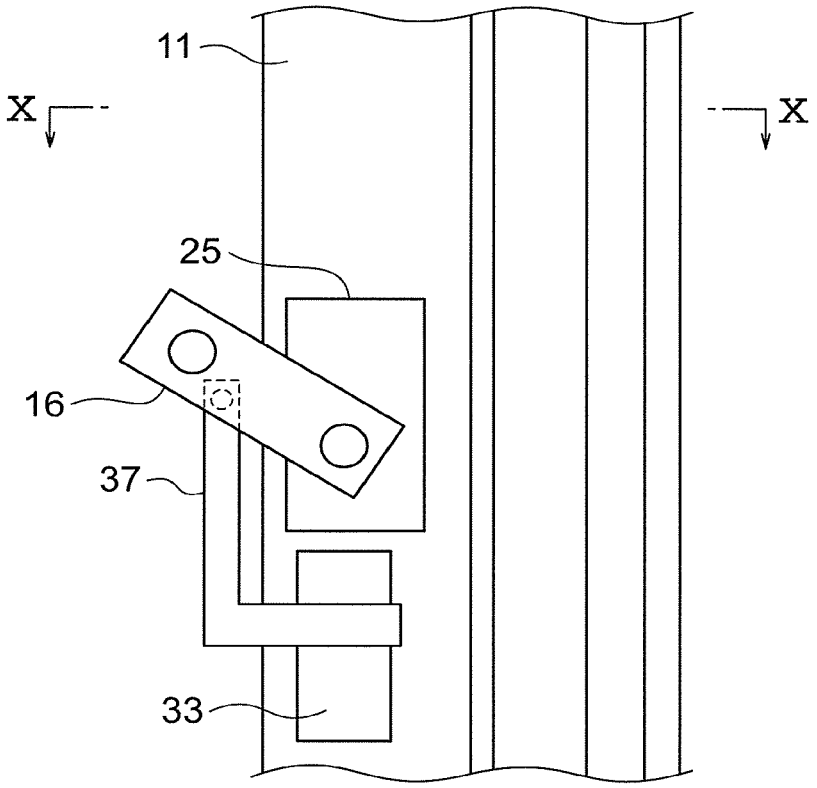
FIG. 9 is a front elevation that shows a relationship between a friction member from FIG. 7 and the activating lever.
Figure 10:
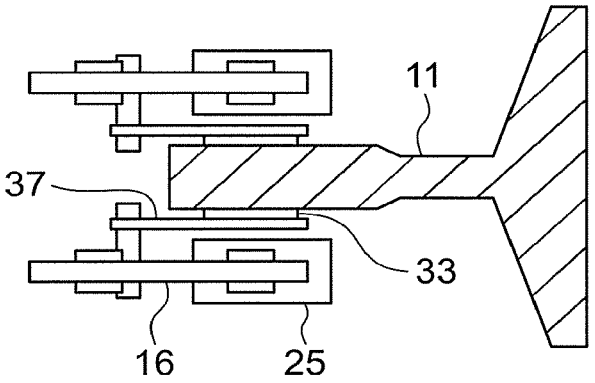
FIG. 10 is a cross section that is taken along Line X-X in FIG. 9.

FIG. 9 is a front elevation that shows a relationship between the friction member 33 from FIG. 7 and the activating levers 16, and FIG. 10 is a cross section that is taken along Line X-X in FIG. 9. The resistance applying mechanism 31 further has a pair of L-shaped linking members 37. Upper end portions of the linking members 37 are rotatably linked to the activating levers 16. The friction members 33 are fixed to lower end portions of the linking members 37. The friction members 33 are linked to the activating levers 16 by means of the linking members 37.

During ascent of the car 9, since the frictional forces between the friction members 33 and the car guide rail 11 increase, a resisting force, i.e., a malfunction preventing force, is applied to the rotation of the activating levers 16 in the direction in which the emergency safety gear 15 is activated. During descent of the car 9, the malfunction preventing force is reduced.

In an elevator apparatus of this kind, because an emergency safety gear 15 can be activated highly responsively using a difference in acceleration between a car 9 and a speed governor mechanism 100 if a suspending body 8 breaks, length of a car buffer 13 can be shortened, enabling space saving to be achieved in a hoistway 1. In addition, because a resisting force is applied to action of activating levers 16 by a resistance applying mechanism 31 during ascent of the car 9, malfunction of the emergency safety gear 15 can be prevented. In other words, by a simple configuration, malfunction of the emergency safety gear 15 is prevented while enabling space saving to be achieved in the hoistway 1.

Because the resistance applying mechanism 31 has a configuration that is approximately a vertical inversion of the emergency safety gear 15, the configuration is simple.

Embodiment 2

Figure 11:
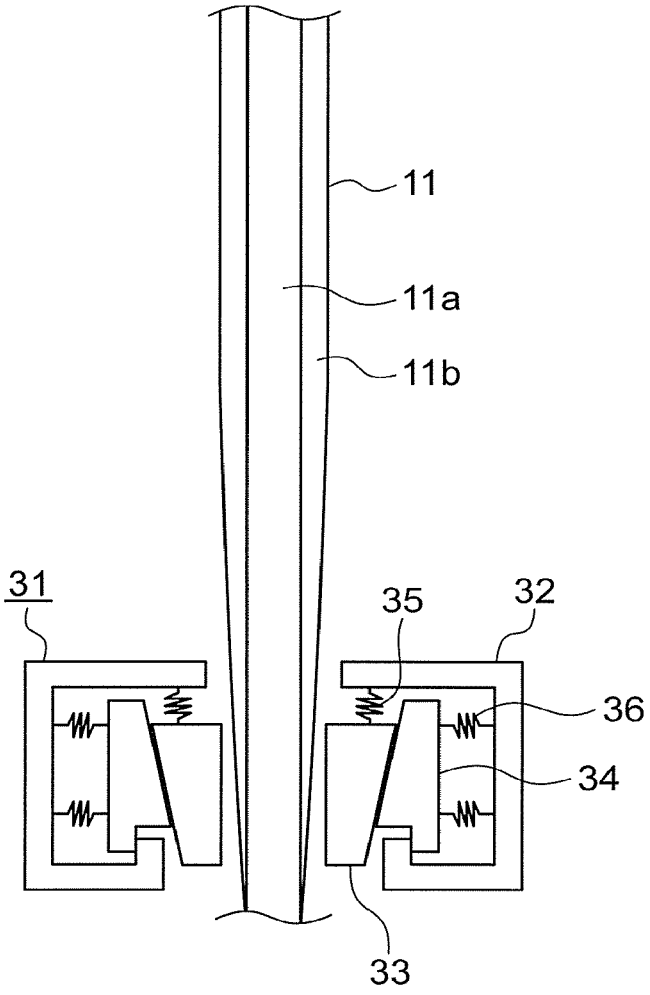
FIG. 11 is a configuration diagram that shows part of an elevator apparatus according to Embodiment 2 of the present invention.
Figure 12:
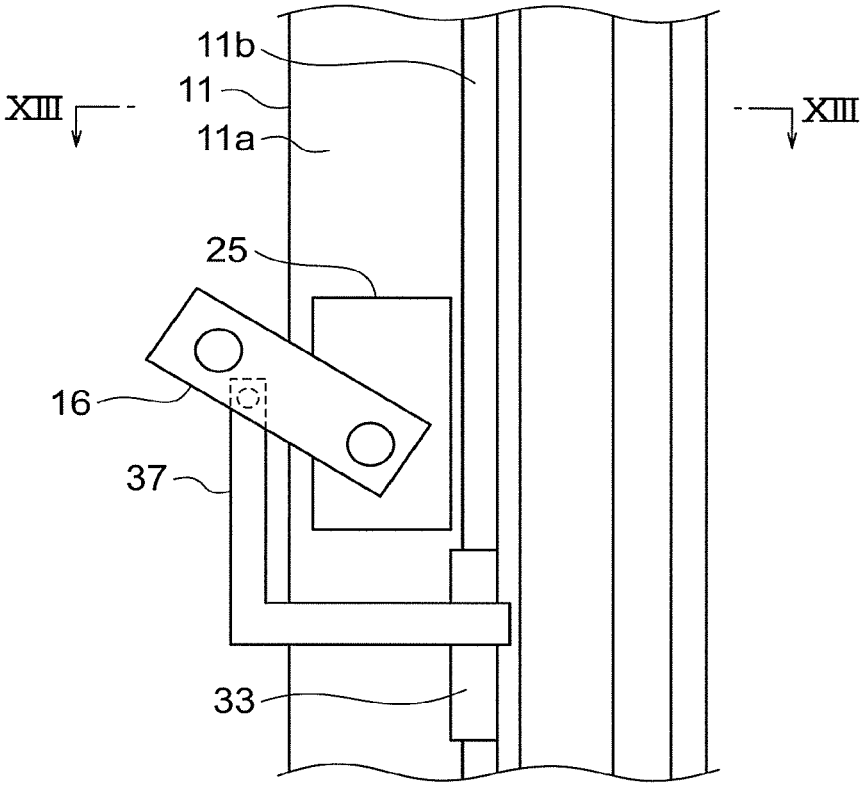
FIG. 12 is a front elevation that shows a relationship between a friction member from FIG. 11 and an activating lever.
Figure 13:
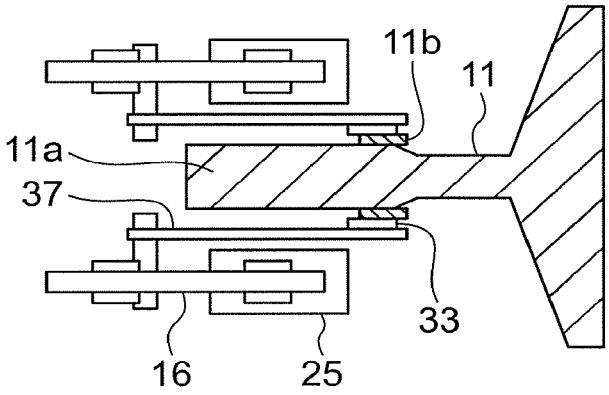
FIG. 13 is a cross section that is taken along Line XIII-XIII in FIG. 12.

Next, FIG. 11 is a configuration diagram that shows part of an elevator apparatus according to Embodiment 2 of the present invention, FIG. 12 is a front elevation that shows a relationship between a friction member 33 from FIG. 11 and activating levers 16, and FIG. 13 is a cross section that is taken along Line XIII-XIII in FIG. 12. A car guide rail 11 according to Embodiment 2 has: a rail main body 11*a*; and a pair of contacting portions 11*b* on surfaces of the rail main body 11*a* that friction members 33 contact.

The contacting portions 11*b* are disposed continuously in a vertical direction so as to avoid regions in which an emergency safety gear 15 and a car guiding shoe (not shown) contact. The contacting portions 11*b* may be configured by fixing separate members to the rail main body 11*a*, or may be constituted by forming protruding portions integrally on the rail main body 11*a*.

In addition, FIG. 11 shows a lower portion of the car guide rail 11, and an incline is disposed on the contacting portions 11*b* in a vicinity of a lowermost floor, so as to separate the friction members 33 from the contacting portions 11*b*. In other words, an amount of protrusion of the contacting portions 11*b* from the rail main body 11*a* is gradually reduced toward a lower end in a vicinity of the lowermost floor.

In this manner, a thickness dimension of the car guide rail 11 changes in the vicinity of the lowermost floor so as to separate the friction members 33 from the car guide rail 11. A remainder of the configuration and operation are similar or identical to those of Embodiment 1.

Moreover, the "vicinity of the lowermost floor" is a region in which the car 9 reaches the rated speed from the lowermost floor of the hoistway 1.

One feature of inertia-activated emergency safety systems is that during complete breakage of a suspending body 8 the emergency safety gear 15 is activated in a constant period of time irrespective of car speed. Because of that, from normal traveling patterns, a car position during breakage of a suspending body 8 at which a car 9 collides with a car buffer 13 before being stopped by an emergency safety gear 15 when the emergency safety gear 15 is activated by complete breakage of the suspending body 8 and the car 9 decelerates can also be defined as a lowermost floor proximity zone, that is, the vicinity of the lowermost floor.

In an elevator apparatus of this kind, because the friction members 33 do not come into contact with a car guide rail 11 in the vicinity of a lowermost floor, the emergency safety gear 15 can be made easy to activate in the case of complete breakage of a suspending body 8 when the car 9 is positioned in a vicinity of the lowermost floor, improving reliability.

Moreover, in Embodiment 2, the amount of protrusion of the contacting portions 11*b* from the rail main body 11*a* changes gradually, but a thickness dimension of the car guide rail 11 may alternatively be changed discontinuously without disposing the contacting portions 11*b* in the vicinity of the lowermost floor. However, by changing the amount of protrusion gradually, the friction members 33 can be placed in contact with the contacting portions 11*b* smoothly as the car 9 ascends from the vicinity of the lowermost floor.

Embodiment 3

Figure 14:
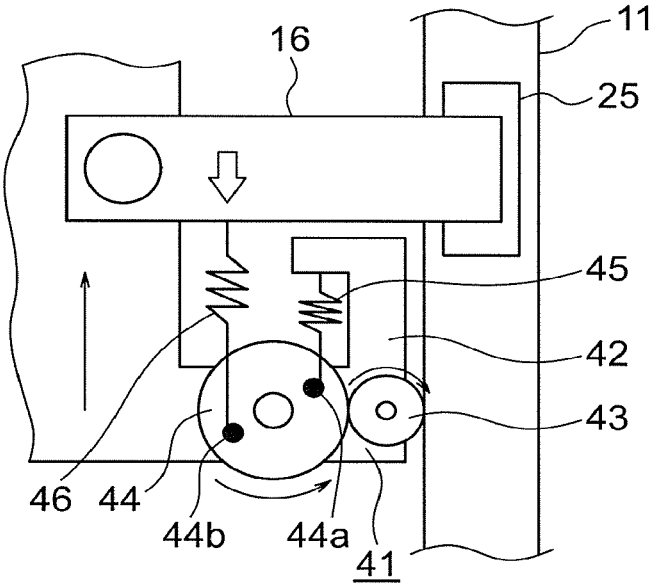
FIG. 14 is a configuration diagram that shows part of an elevator apparatus according to Embodiment 3 of the present invention.

Next, FIG. 14 is a configuration diagram that shows part of an elevator apparatus according to Embodiment 3 of the present invention, and shows a state during ascent of a car 9. A resistance applying mechanism 41 according to Embodiment 3 has a supporting portion 42, a rotating roller 43, a slipping roller 44, a first spring 45, and a second spring 46.

The supporting portion 42 is fixed to a lower portion of the car 9. The rotating roller 43 is disposed on the supporting portion 42 and rotates while contacting the car guide rail 11 due to traveling of the car 9. A rotating shaft of the rotating roller 43 is disposed horizontally parallel to rotating shafts of activating levers 16.

The slipping roller 44 is disposed on the supporting portion 42 next to the rotating roller 43. An outer circumference of the slipping roller 44 contacts an outer circumference of the rotating roller 43. A rotating shaft of the slipping roller 44 is disposed horizontally parallel to a rotating shaft of the rotating roller 43. A diameter of the slipping roller 44 is larger than a diameter of the rotating roller 43.

First and second spring securing portions 44*a* and 44*b* are disposed on side surfaces of the slipping roller 44. The first and second spring securing portions 44*a* and 44*b* are disposed symmetrically on opposite sides of the rotating shaft of the slipping roller 44 from each other.

The first spring 45 is disposed between the first spring securing portion 44*a* and the supporting portion 42. The second spring 46 is disposed between the second spring securing portion 44*b* and the activating levers 16. The second spring 46 constitutes a connecting member that connects the slipping roller 44 and the activating levers 16.

When the car 9 travels, rotation of the rotating roller 43 is transmitted such that the slipping roller 44 rotates within a range of a set angle in a direction that corresponds to a direction of travel of the car 9. The rotating roller 43 slips relative to the slipping roller 44 and spins in a state in which the slipping roller 44 has rotated by the set angle.

During ascent of the car 9, the rotating roller 43 rotates clockwise in FIG. 14, and the slipping roller 44 rotates counterclockwise in FIG. 14. Then, due to the slipping roller 44 rotating by the set angle, the rolling frictional force between the rotating roller 43 and the slipping roller 44 is applied to the activating levers 16 as a resisting force by means of the second spring 46.

During descent of the car 9, the rotating roller 43 rotates counterclockwise in FIG. 14, and the slipping roller 44 rotates clockwise in FIG. 14. Resisting force against movement of the activating levers 16 in the direction that activates the emergency safety gear 15 is thereby reduced. However, rotation of the activating levers 16 during normal running is prevented by the rotational spring 22.

Figure 15:
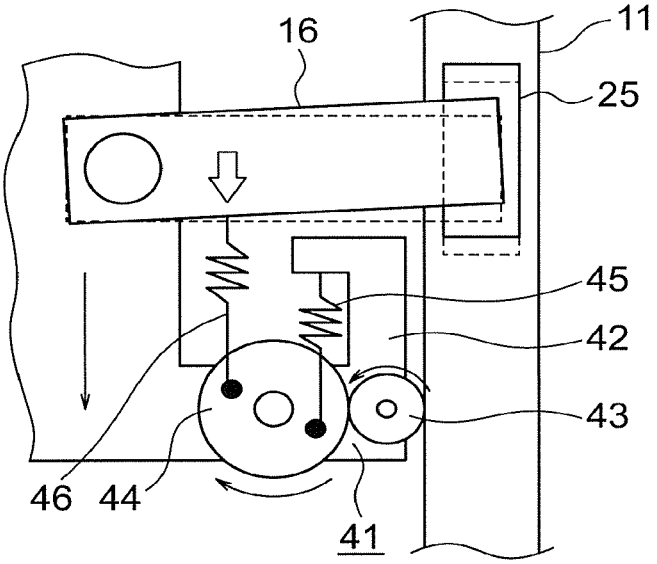
FIG. 15 is a configuration diagram that shows a state of a resistance applying mechanism from FIG. 14 during emergency safety gear activation.

FIG. 15 is a configuration diagram that shows a state of the resistance applying mechanism 41 from FIG. 14 during activation of the emergency safety gear 15. Because the activating levers 16 are not pulled by the second spring 46 during descent of the car 9, the activating levers 16 will rotate immediately due to the difference in acceleration due to breakage of the suspending body 8, activating the emergency safety gear 15.

Moreover, the rolling frictional force between the rotating roller 43 and the slipping roller 44 does not hinder traveling of the car 9 either during ascent or during descent of the car 9. A remainder of the configuration and operation are similar or identical to those of Embodiment 1 or 2.

In an elevator apparatus of this kind, because an emergency safety gear 15 can be activated highly responsively using a difference in acceleration between a car 9 and a speed governor mechanism 100 if a suspending body 8 breaks, length of a car buffer 13 can be shortened, enabling space saving to be achieved in a hoistway 1. In addition, because a resisting force is applied to action of activating levers 16 by a resistance applying mechanism 41 during ascent of the car 9, malfunction of the emergency safety gear 15 can be prevented. In other words, by a simple configuration, malfunction of the emergency safety gear 15 is prevented while enabling space saving to be achieved in the hoistway 1.

Embodiment 4

Figure 16:
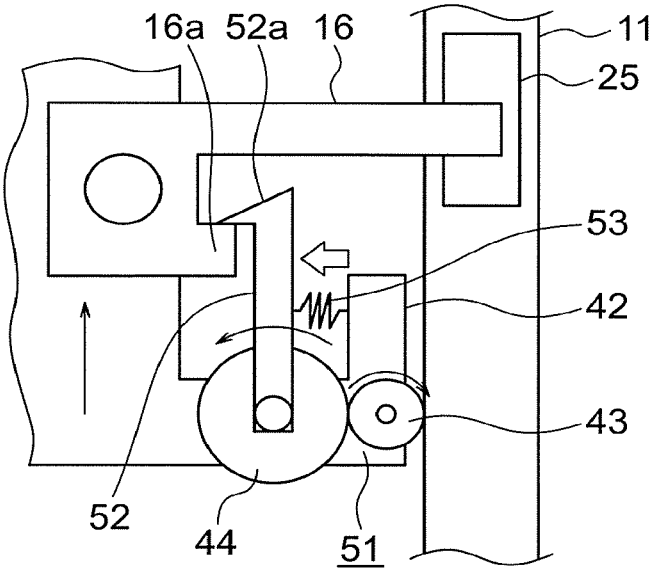
FIG. 16 is a configuration diagram that shows part of an elevator apparatus according to Embodiment 4 of the present invention.

Next, FIG. 16 is a configuration diagram that shows part of an elevator apparatus according to Embodiment 4 of the present invention, and shows a state during ascent of a car 9. In Embodiment 4, a catching portion 16*a* is disposed on activating levers 16.

An activation restricting mechanism 51 is disposed on a car 9, instead of a resistance applying mechanism. The activation restricting mechanism 51 restricts movement of the activating levers 16 in the direction that activates the emergency safety gear 15 during ascent of the car 9. The activation restricting mechanism 51 releases the restriction on the movement of the activating levers 16 during descent of the car 9.

In addition, the activation restricting mechanism 51 has a supporting portion 42, a rotating roller 43, and a slipping roller 44 that are similar or identical to those of Embodiment 3. The activation restricting mechanism 51 further has a movable member 52 and a return spring 53.

The movable member 52 is fixed to a side surface of the slipping roller 44, and rotates around the rotating shaft of the slipping roller 44 together with the slipping roller 44. A hook portion 52*a* that is hooked onto the catching portion 16*a* is disposed on a tip portion of the movable member 52.

The return spring 53 is disposed between the movable member 52 and the supporting portion 42, and applies a force to the movable member 52 that separates the hook portion 52*a* from the catching portion 16*a*.

Figure 17:
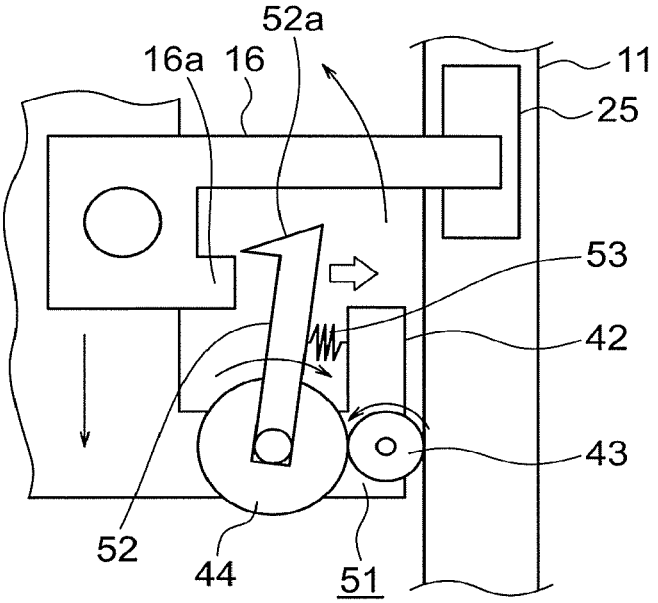
FIG. 17 is a configuration diagram that shows a state of an activation restricting mechanism from FIG. 16 during descent of a car.

FIG. 17 is a configuration diagram that shows a state of an activation restricting mechanism 51 from FIG. 16 during descent of the car 9. The rotating roller 43 rotates while contacting the car guide rail 11 due to traveling of the car 9 and displaces the movable member 52 depending on a direction of rotation. The movable member 52 is thereby displaceable between a restricting position (FIG. 16) that is hooked onto the catching portion 16*a*, and a releasing position (FIG. 17) that is separated from the catching portion 16*a*.

Specifically, during ascent of the car 9, the rotating roller 43 rotates clockwise in FIG. 16, and the slipping roller 44 rotates counterclockwise in FIG. 16 in opposition to the return spring 53, displacing the movable member 52 to the restricting position. Rotation of the activating levers 16 in the direction that activates the emergency safety gear 15 is thereby restricted.

During descent of the car 9, the rotating roller 43 rotates counterclockwise in FIG. 17, and the slipping roller 44 rotates clockwise in FIG. 17, displacing the movable member 52 to the releasing position. A state is thereby entered in which rotation of the activating levers 16 in the direction that activates the emergency safety gear 15 is permitted. A remainder of the configuration and operation are similar or identical to those of Embodiment 1 or 2.

In an elevator apparatus of this kind, because an emergency safety gear 15 can be activated highly responsively using a difference in acceleration between a car 9 and a speed governor mechanism 100 if a suspending body 8 breaks, length of a car buffer 13 can be shortened, enabling space saving to be achieved in a hoistway 1. In addition, because action of activating levers 16 is restricted by an activation restricting mechanism 51 during ascent of the car 9, malfunction of the emergency safety gear 15 can be prevented. In other words, by a simple configuration, malfunction of the emergency safety gear 15 is prevented while enabling space saving to be achieved in the hoistway 1.

Moreover, in Embodiment 4, the movable member 52 is displaced to the restricting position by rolling frictional force, but the movable member 52 can alternatively be displaced to the restricting position by a spring force, and the movable member 52 displaced to the releasing position by rolling frictional force.

In that case, for example, the contacting portion that the rotating roller 43 contacts may be disposed on the car guide rail 11 only in a vicinity of the lowermost floor, such that the rotating roller 43 comes into contact with the car guide rail 11 only in the vicinity of the lowermost floor. The movable member 52 can thereby be displaced to the releasing position only when the car 9 descends to the vicinity of the lowermost floor.

By making the force that removes the hook portion 52*a* from the catching portion 16*a* correspond to the lifting force on the activating levers 16 by the speed governor 17, the emergency safety gear 15 can be activated even when the governor is tripped. This does not need to be considered during descent, but is a required configuration if using upward emergency safeties.

Embodiment 5

Figure 18:
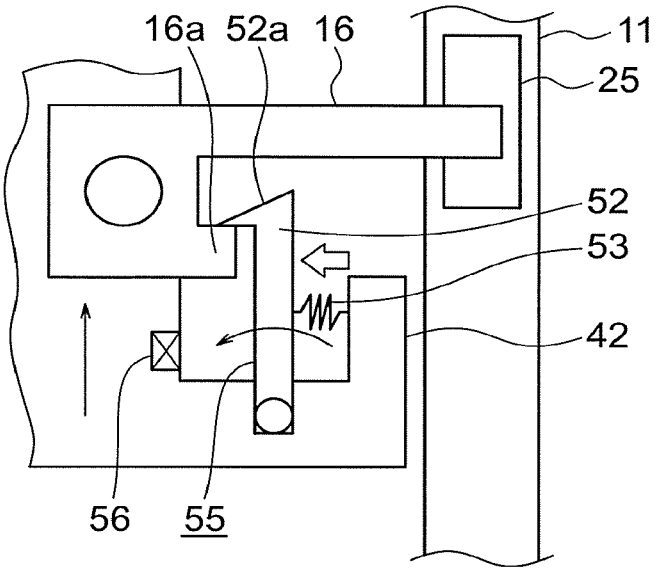
FIG. 18 is a configuration diagram that shows part of an elevator apparatus according to Embodiment 5 of the present invention.

Next, FIG. 18 is a configuration diagram that shows part of an elevator apparatus according to Embodiment 5 of the present invention, and shows a state during ascent of a car 9. An activation restricting mechanism 55 according to Embodiment 5 has a supporting portion 42, a movable member 52, a return spring 53, and an electromagnet 56. In Embodiment 5, a rotating roller 43 and a slipping roller 44 are not used, and the movable member 52 is linked directly to the supporting portion 42.

The electromagnet 56 displaces the movable member 52 to the restricting position in opposition to the return spring 53 using a generated electromagnetic force. In other words, the movable member 52 is a driving portion that displaces the movable member 52 using electric power depending on the direction of travel of the car 9. Passage of electric current to the electromagnet 56 is controlled by a controlling apparatus 5.

Specifically, the electric power is supplied to the electromagnet 56 during ascent of the car 9. The movable member 52 is attracted by the electromagnetic force from the electromagnet 56 and thereby displaces to the restricting position in opposition to the return spring 53.

Figure 19:
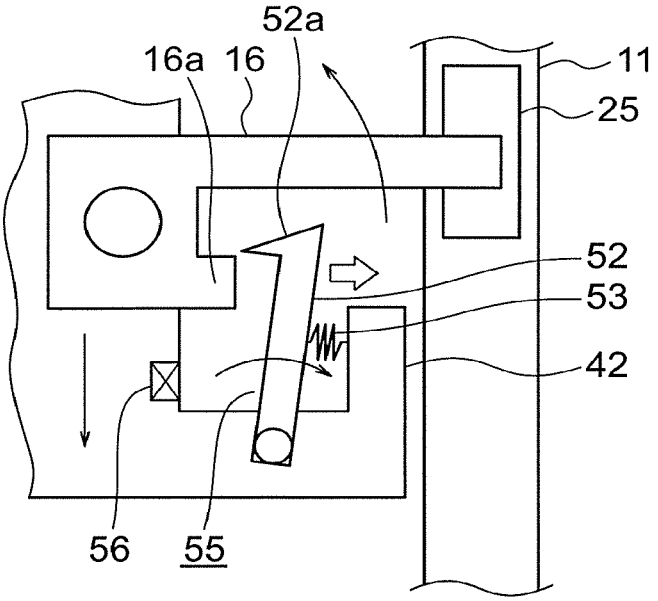
FIG. 19 is a configuration diagram that shows a state of an activation restricting mechanism from FIG. 18 during descent of a car.

The passage of electric current to the electromagnet 56 is interrupted during descent of the car 9. As shown in FIG. 19, the movable member 52 thereby displaces to the releasing position due to the force of recovery of the return spring 53. A remainder of the configuration and operation are similar or identical to those of Embodiment 4.

Similar or identical effects to those of Embodiment 4 can also be achieved this kind of configuration. Timing for restricting the movement of the activating levers 16 can also be controlled more reliably using electrical signals.

Moreover, in Embodiment 5, the movable member 52 is displaced to the restricting position by passing electric current to the electromagnet 56, but the movable member 52 can alternatively be displaced to the restricting position by a spring force, and the movable member 52 displaced to the releasing position by electromagnetic force.

Timing for displacing the movable member 52 to the releasing position may be limited to when it is detected that car acceleration is 1 G downward during descent of the car 9. Furthermore, timing for displacing the movable member 52 to the releasing position may be limited to when breakage of the suspending body 8 is detected during descent of the car 9. In those cases, malfunction of the emergency safety gear 15 can be prevented during descent of the car 9.

Embodiment 6

Figure 20:
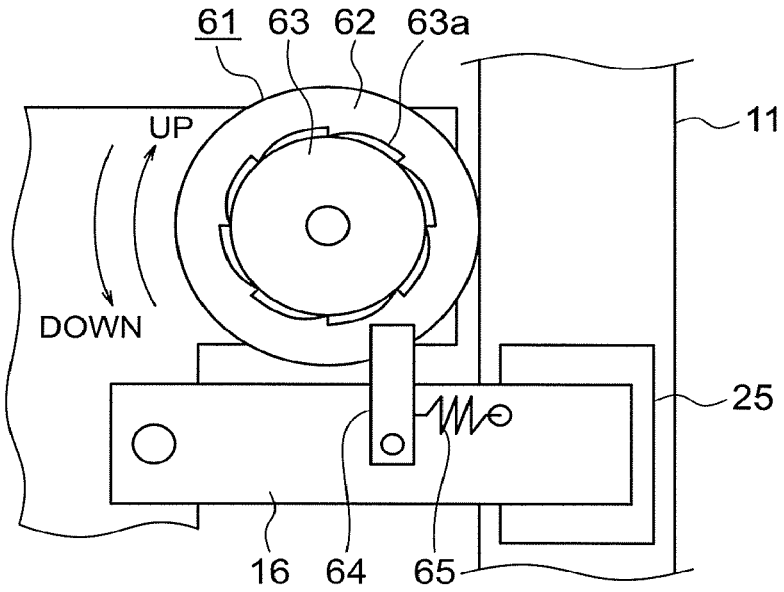
FIG. 20 is a configuration diagram that shows part of an elevator apparatus according to Embodiment 6 of the present invention.

Next, FIG. 20 is a configuration diagram that shows part of an elevator apparatus according to Embodiment 6 of the present invention. An activation restricting mechanism 61 according to Embodiment 6 has a rotating roller 62, a cylindrical rotating body 63, a link 64, and a connecting spring 65.

The rotating roller 62 is rotatably disposed above activating levers 16 on a lower portion of a car 9, and rotates while contacting a car guide rail 11 due to traveling of the car 9. The rotating body 63 is disposed so as to be coaxial with the rotating roller 62, and rotates together with the rotating roller 62. A plurality of hook-shaped projections 63*a* are disposed on an outer circumference of the rotating body 63.

The link 64 is rotatably disposed on the activating levers 16. A gap is disposed between the link 64 and the outer circumference of the rotating body 63 during normal operation. The link 64 is disposed such that an upper end portion contacts the projections 63*a* due to the activating levers 16 moving in a direction that activates an emergency safety gear 15. The connecting spring 65 is disposed between an intermediate portion of the link 64 and the activating levers 16.

A shape of the projections 63*a* restricts movement of the activating levers 16 in the direction that activates the emergency safety gear 15 by means of the link 64 during ascent of the car 9, and permits the movement of the activating levers 16 in the direction that activates the emergency safety gear 15 during descent of the car 9.

During ascent of the car 9, the rotating roller 62 and the rotating body 63 rotate clockwise in FIG. 20. Because of that, even if the activating levers 16 rotate in the direction that activates the emergency safety gear 15, the link 64 contacts the projections 63*a*, and the amount of displacement of the activating levers 16 is limited.

During descent of the car 9, the rotating roller 62 and the rotating body 63 rotate counterclockwise in FIG. 20. Because of that, even if the link 64 contacts the outer circumference of the rotating body 63, it will not catch on the projections 63*a*, and rotation of the activating levers 16 to the position that activates the emergency safety gear 15 is permitted.

Figure 21:
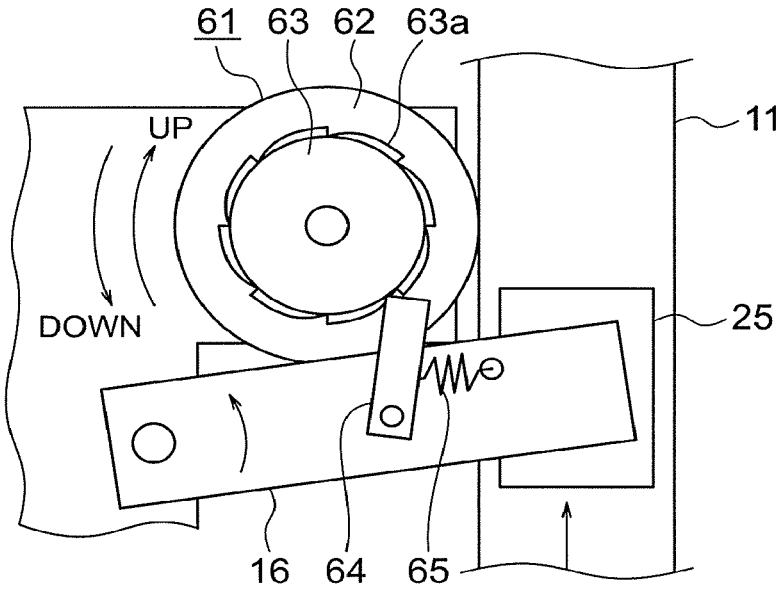
FIG. 21 is a configuration diagram that shows a state of an activation restricting mechanism from FIG. 20 during emergency safety gear activation.

FIG. 21 is a configuration diagram that shows a state of the activation restricting mechanism 61 from FIG. 20 during activation of the emergency safety gear 15. Since the connecting spring 65 is compressed when the link 64 contacts the outer circumference of the rotating body 63, the activating levers 16 are subjected to some resistance to being pulled upward. However, during descent of the car 9, the activating levers 16 can be changed to the position that activates the emergency safety gear 15 without being subjected to a large resisting force from the rotating body 63. A remainder of the configuration and operation are similar or identical to those of Embodiment 1 or 2.

In an elevator apparatus of this kind, because an emergency safety gear 15 can be activated highly responsively using a difference in acceleration between a car 9 and a speed governor mechanism 100 if a suspending body 8 breaks, length of a car buffer 13 can be shortened, enabling space saving to be achieved in a hoistway 1. In addition, because action of activating levers 16 is restricted by an activation restricting mechanism 61 during ascent of the car 9, malfunction of the emergency safety gear 15 can be prevented. In other words, by a simple configuration, malfunction of the emergency safety gear 15 is prevented while enabling space saving to be achieved in the hoistway 1.

Moreover, a car guiding roller that guides raising and lowering of a car 9 by rolling along a car guide rail 11 may also function as the rotating roller 62 according to Embodiment 6.

Moreover, in FIG. 1, a one-to-one (1:1) roping elevator apparatus is shown, but the roping method is not limited thereto, and the present invention can also be applied to two-to-one (2:1) roping elevator apparatuses, for example.

Furthermore, the present invention can also be applied to machine-roomless elevators that do not have a machine room 2, or to various other types of elevator apparatus, etc.

The invention claimed is:

1. An elevator apparatus comprising:

a car that ascends and descends through a hoistway;

a car guide rail that guides ascent and descent of the car;

a suspending body that suspends the car;

an emergency safety gear that is disposed on the car, and that grips the car guide rail to make the car perform emergency stopping;

an activating lever that is disposed on the emergency safety gear, and that activates the emergency safety gear;

a speed governor mechanism that comprises:

a speed governor sheave;

a tensioning sheave that is disposed so as to be spaced apart from the speed governor sheave in a vertical direction; and a speed governor rope that is wound onto the speed governor sheave and the tensioning sheave, and that is connected to the activating lever; and a resistance applying mechanism that is disposed on the car, and that applies a resisting force during ascent of the car against movement of the activating lever in a direction that activates the emergency safety gear, wherein the resistance applying mechanism comprises a housing, a wedge-shaped friction member, a friction member guide, and a guide pressing spring;

the friction member is in contact with the car guide rail, and is linked to the activating lever;

an inclined surface that approaches the car guide rail toward a lower end is disposed on the friction member guide;

the friction member is movable vertically relative to the housing along the inclined surface;

the guide pressing spring is disposed between the housing and the friction member guide;

the friction member wedges in downward against the friction member guide during ascent of the car due to a frictional force that acts on the friction member such that spacing between the friction member guide and the car guide rail is pushed wider and the guide pressing spring is compressed to increase frictional force between the friction member and the car guide rail; and whenever the resistance applying mechanism is activated, the speed governor rope is entirely linear at the car.

2. The elevator apparatus according to claim 1, wherein a thickness dimension of the car guide rail changes in a vicinity of a lowermost floor so as to separate the friction member from the car guide rail.

3. The elevator apparatus according to claim 1, further comprising:

a link connecting the activating lever and the wedge-shaped friction member, wherein during the ascent of the car, a frictional force against the friction member increases which increases an amount of force which must be exerted on the activating lever to activate the emergency safety gear.

4. The elevator apparatus according to claim 1, further comprising:

a lifting rod connected between the speed governor rope and the activating lever, the lifting rod transmitting a force from the speed governor rope to the activating lever, an angle between the lifting rod and the speed governor rope changing when the activating lever moves.

5. The elevator apparatus according to claim 1, wherein:

the lifting rod is pivotally connected to the speed governor rope, and the lifting rod is pivotally connected to the activating lever.

6. The elevator apparatus according to claim 1, wherein:

during descent of the car, the frictional force between the friction member and the guide rail is decreased.

7. An elevator apparatus comprising:

a car that ascends and descends through a hoistway;

a car guide rail that guides ascent and descent of the car;

a suspending body that suspends the car;

an emergency brake that is disposed on the car and that grips the car guide rail;

an activating lever, connected to the emergency brake, that activates the emergency brake;

a speed governor mechanism that comprises:

a speed governor sheave;

a tensioning sheave that is disposed so as to be spaced apart from the speed governor sheave in a vertical direction; and a speed governor rope that is wound onto the speed governor sheave and the tensioning sheave, and that is connected to the activating lever; and an activation restrictor, including:

a friction structure to engage with the car guide rail; and a link connecting the activating lever and the friction structure, wherein during the ascent of the car, a frictional force due to contact between the friction structure and the car guide rail increases which increases an amount of force which must be exerted on the activating lever to activate the emergency brake, and wherein whenever the resistance applying mechanism is activated, the speed governor rope is entirely linear at the car.

8. The elevator apparatus according to claim 7, further comprising:

a lifting rod connected between the speed governor rope and the activating lever, the lifting rod transmitting a force from the speed governor rope to the activating lever, an angle between the lifting rod and the speed governor rope changing when the activating lever moves.

9. The elevator apparatus according to claim 8, wherein:

the lifting rod is pivotally connected to the speed governor rope, and the lifting rod is pivotally connected to the activating lever.

10. The elevator apparatus according to claim 7, wherein:

during descent of the car, the frictional force between the friction member and the guide rail is decreased.

* * * * *